US012157199B2

(12) United States Patent
Bruce et al.

(10) Patent No.: US 12,157,199 B2
(45) Date of Patent: Dec. 3, 2024

(54) CENTERLESS GRINDING THROUGH THE APPLICATION OF A HELICAL TWIST TO AXIAL GROOVES

(71) Applicant: BorgWarner Inc., Auburn Hills, MI (US)

(72) Inventors: Adam Bruce, Ithaca, NY (US); Brian Kenyon, McGraw, NY (US); Philippe Alain Clayton, Camparada (IT)

(73) Assignee: BorgWarner Inc., Auburn Hills, MI (US)

( * ) Notice: Subject to any disclaimer, the term of this patent is extended or adjusted under 35 U.S.C. 154(b) by 1127 days.

(21) Appl. No.: 16/792,529

(22) Filed: Feb. 17, 2020

(65) Prior Publication Data

US 2020/0269379 A1 Aug. 27, 2020

Related U.S. Application Data

(60) Provisional application No. 62/809,084, filed on Feb. 22, 2019.

(51) Int. Cl.

| | |
|---|---|
| ***B24B 19/02*** | (2006.01) |
| ***B24B 5/22*** | (2006.01) |
| ***B24B 41/06*** | (2012.01) |
| *B24B 5/35* | (2006.01) |
| *B24B 27/00* | (2006.01) |
| *F01L 1/344* | (2006.01) |

(52) U.S. Cl.

CPC ..... *B24B 19/022* (2013.01); *B24B 5/22* (2013.01); *B24B 41/061* (2013.01); *B24B 5/35* (2013.01); *B24B 27/0076* (2013.01); *F01L 2001/34426* (2013.01)

(58) Field of Classification Search

CPC ..... B24B 19/022; B24B 5/22; B24B 41/061; B24B 27/0076; B24B 5/35; F01L 2001/34426

See application file for complete search history.

(56) References Cited

U.S. PATENT DOCUMENTS

| | | | | | |
|---|---|---|---|---|---|
| 2,865,217 | A | * | 12/1958 | Bishop | B62D 5/24 91/380 |
| 3,680,262 | A | * | 8/1972 | Aydelott | B24B 3/065 451/48 |
| 3,730,018 | A | * | 5/1973 | Bishop | F16H 1/16 74/498 |
| 3,788,603 | A | * | 1/1974 | Snider | F16K 3/26 251/345 |
| 3,874,637 | A | * | 4/1975 | Jones | F16K 3/26 251/339 |
| 4,580,905 | A | * | 4/1986 | Schwitters | A23G 9/282 366/156.1 |
| 5,178,030 | A | * | 1/1993 | Bousquet | F15B 15/068 74/99 A |
| 5,263,443 | A | * | 11/1993 | Schechter | F01L 1/34409 123/90.31 |

(Continued)

*Primary Examiner* — Craig M Schneider
*Assistant Examiner* — Christopher D Ballman
(74) *Attorney, Agent, or Firm* — Brown & Michaels, PC

(57) ABSTRACT

A cylindrical workpiece with a helical axial groove allowing for centerless grinding which has an angular overlap around the outer circumference on the body of the workpiece. The angular overlap ensures continuous tangential contact with the grinding wheels as the workpiece is rotated.

18 Claims, 6 Drawing Sheets

(56) References Cited

U.S. PATENT DOCUMENTS

| | | | | |
|---|---|---|---|---|
| 6,427,992 | B1 * | 8/2002 | Noda | B25B 5/064 269/24 |
| 6,662,877 | B2 * | 12/2003 | Patel | E21B 34/14 166/332.3 |
| 6,666,129 | B1 * | 12/2003 | Schmid | F16K 31/1635 92/136 |
| 7,290,480 | B2 * | 11/2007 | Rentz | F15B 15/063 92/136 |
| 7,386,981 | B2 * | 6/2008 | Zielinski | F02C 7/22 60/39.281 |
| 9,206,714 | B2 * | 12/2015 | Koehler | F01L 1/3442 |
| 9,964,127 | B2 * | 5/2018 | Burmester | F16K 31/5282 |
| 10,100,850 | B1 * | 10/2018 | Raymond | F15B 15/068 |
| 10,161,273 | B2 * | 12/2018 | Asahi | F01L 1/047 |
| 10,458,559 | B2 * | 10/2019 | Fanzani | F16K 15/144 |
| 10,605,127 | B2 * | 3/2020 | Benischek | F01L 1/34409 |
| 2014/0057534 | A1 * | 2/2014 | Hajduk | B24D 3/28 451/41 |
| 2014/0116365 | A1 * | 5/2014 | Scheidig | F01L 1/344 123/90.17 |
| 2017/0022854 | A1 * | 1/2017 | Takada | F01L 1/047 |
| 2019/0368387 | A1 * | 12/2019 | Mitsutani | F16K 15/1825 |

* cited by examiner

CENTERLESS GRINDING THROUGH THE APPLICATION OF A HELICAL TWIST TO AXIAL GROOVES

CROSS-REFERENCE TO RELATED APPLICATIONS

This application claims the benefit of U.S. Patent Application No. 62/809,084 filed on Feb. 22, 2019, the disclosure of which is herein incorporated by reference in its entirety.

BACKGROUND OF THE INVENTION

Field of the Invention

The invention pertains to the field of centerless grinding. More particularly, the invention pertains to centerless grinding through the application of a helical twist to axial grooves or slots of a cylindrical workpiece to prevent parts from developing flat spots.

Description of Related Art

Centerless grinding is a machining process that uses abrasive cutting wheels to remove material from the outer diameter of a cylindrical workpiece. Workpieces with slots on the outer diameter which extend along the entire axis cannot be centerless ground, as during the grinding process the workpiece will stop on the slot or flat.

FIG. 5*a* shows a schematic of a centerless grinding layout. For the centerless grinding process, the workpiece 2 sits on a platform 3 and is secured between two rotary grinding wheels 5, 6, which rotate in the same direction, but at different speeds. The first grinding wheel 5, may be on a fixed axis and may rotate such that the force applied to the workpiece 2 is directed downward against the platform 3. The second grinding wheel or regulating wheel 6 is moveable and controls the rotational speed and feed rate or linear travel of the workpiece 2. The regulating wheel 6 applies a lateral pressure to the workpiece 2.

The speed of the first and second grinding wheels 5, 6 relative to each other determines the rate at which material is removed from the workpiece 2. The tangential speed of the first grinding wheel 5 is greater than the second grinding wheel 6.

In order for centerless grinding of a workpiece 2 to occur, the workpiece 2 needs to be in contact with the two grinding wheels 5, 6 at all times along the outer diameter of the workpiece 2 to be ground and along the axis A-A of the workpiece 2. This can be challenging for workpieces that require or have an axial slot 7 on the outer diameter 2*a* that runs along the axis A-A of the piece 2, as continuous contact between the two grinding wheels 5, 6 is interrupted, for example as shown in FIGS. 1 and 5*b*. An example of a workpiece with an axial slot may be a sleeve or control valve of a variable cam timing phaser. The axial slot is required as a flow path for fluid to travel. Previous solutions, as shown in FIG. 4, require separate axial jogs 9, 10 followed by an angular sweep or jog 11 to provide a workpiece 20 that contains an axial slot 10 on the outer diameter 20*a* and can undergo the centerless grinding process.

SUMMARY OF THE INVENTION

In one embodiment, a workpiece includes a helical feature which allows for centerless grinding of a workpiece with slots on the outer diameter. The helical feature can include a helical twist which can be applied to grooves on the outer diameter or workpiece to ensure that the grinding wheels maintain contact with the outer diameter of the workpiece at all times.

In another embodiment, a method of manufacturing a control sleeve or control valve for a variable cam timing phaser is disclosed. The method comprising the steps of: placing a workpiece on a platform, the workpiece comprising: a body with an outer circumference having a first end and a second end separated by a length; and a continuous helical groove extending from a first end to the second end a depth from the outer circumference, the helical groove having a surface the depth from the outer circumference connected to a first side and a second side; wherein the helical groove has an angular overlap around the outer circumference of the body measured between an imaginary line drawn from a first edge of the first side at the first end to the second end and to a second edge of the first side at the second end, securing the workpiece between two rotary grinding wheels which rotate at the same speed in different directions; grinding the workpiece such that the angular overlap ensures continuous tangential contact with the two rotary grinding wheels as the workpiece is rotated.

In yet another embodiment, a method of manufacturing a control sleeve or control valve for a variable cam timing phaser is disclosed. The method comprising the steps of: placing a workpiece on a platform, the workpiece comprising: a body with an outer circumference having a first end and a second end separated by a length; and a continuous helical slot comprising: a first axial slot at a first end extending a length towards the second end having a depth from the outer circumference, the first axial slot having a flat surface at the depth from the outer circumference, the flat surface connected to a first side and a second side; a helical jog having a surface at the depth having first helical jog side and a second helical jog side connected to the first side and the second side of the first axial slot, the helical jog extending a length towards the second end; and a second axial slot having a flat surface at the depth connected to a first side and a second side connected to the first helical jog side and the second helical jog side; securing the workpiece between two rotary grinding wheels which rotate at the same speed in different directions; grinding the workpiece such that the angular overlap ensures continuous tangential contact with the two rotary grinding wheels as the workpiece is rotated.

DETAILED DESCRIPTION OF THE INVENTION

Figure 1:
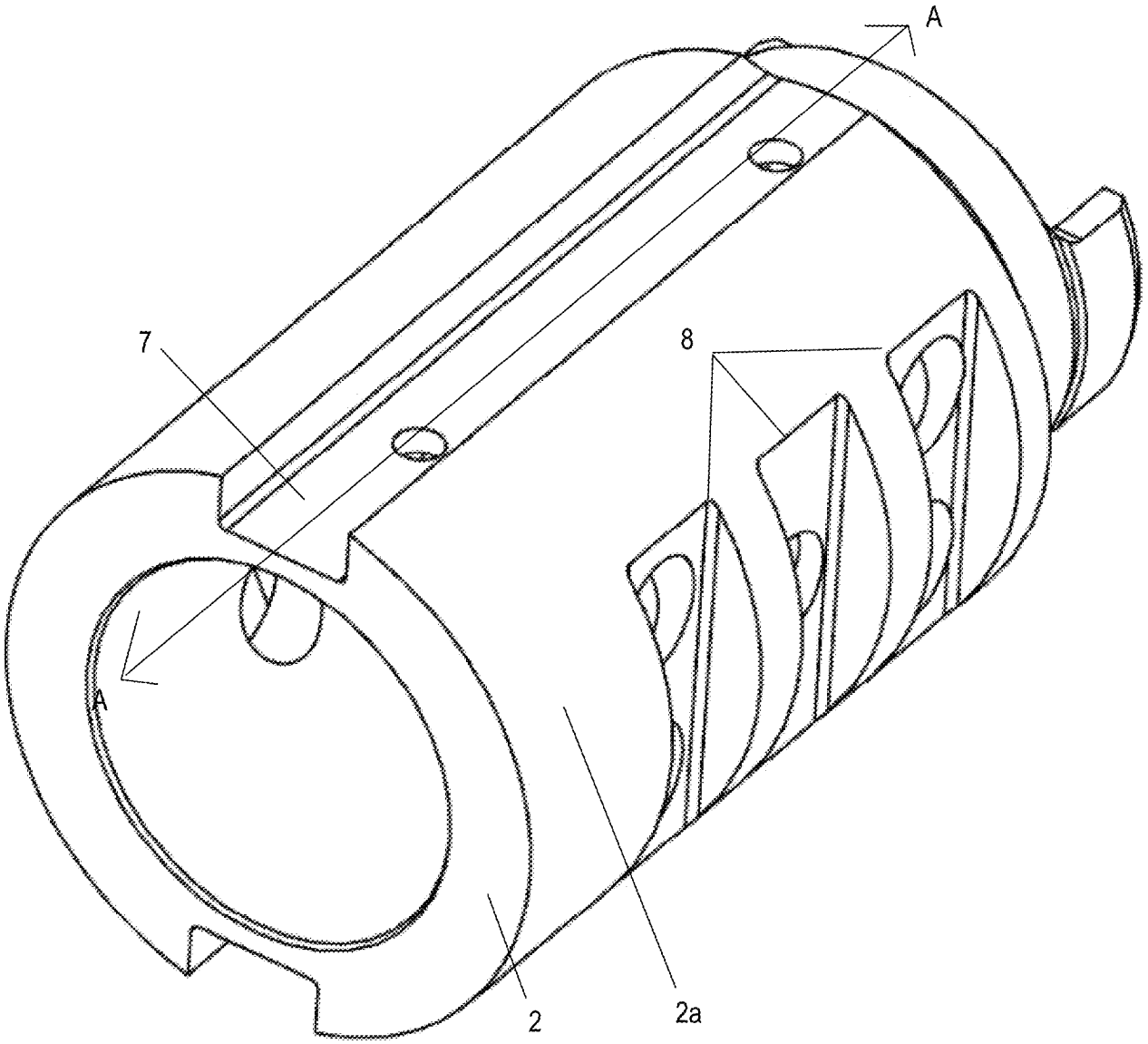
Fig. 1 Prior Art
FIG. 1 shows a schematic of a conventional workpiece containing an axial slot along an axis.
Figure 2:
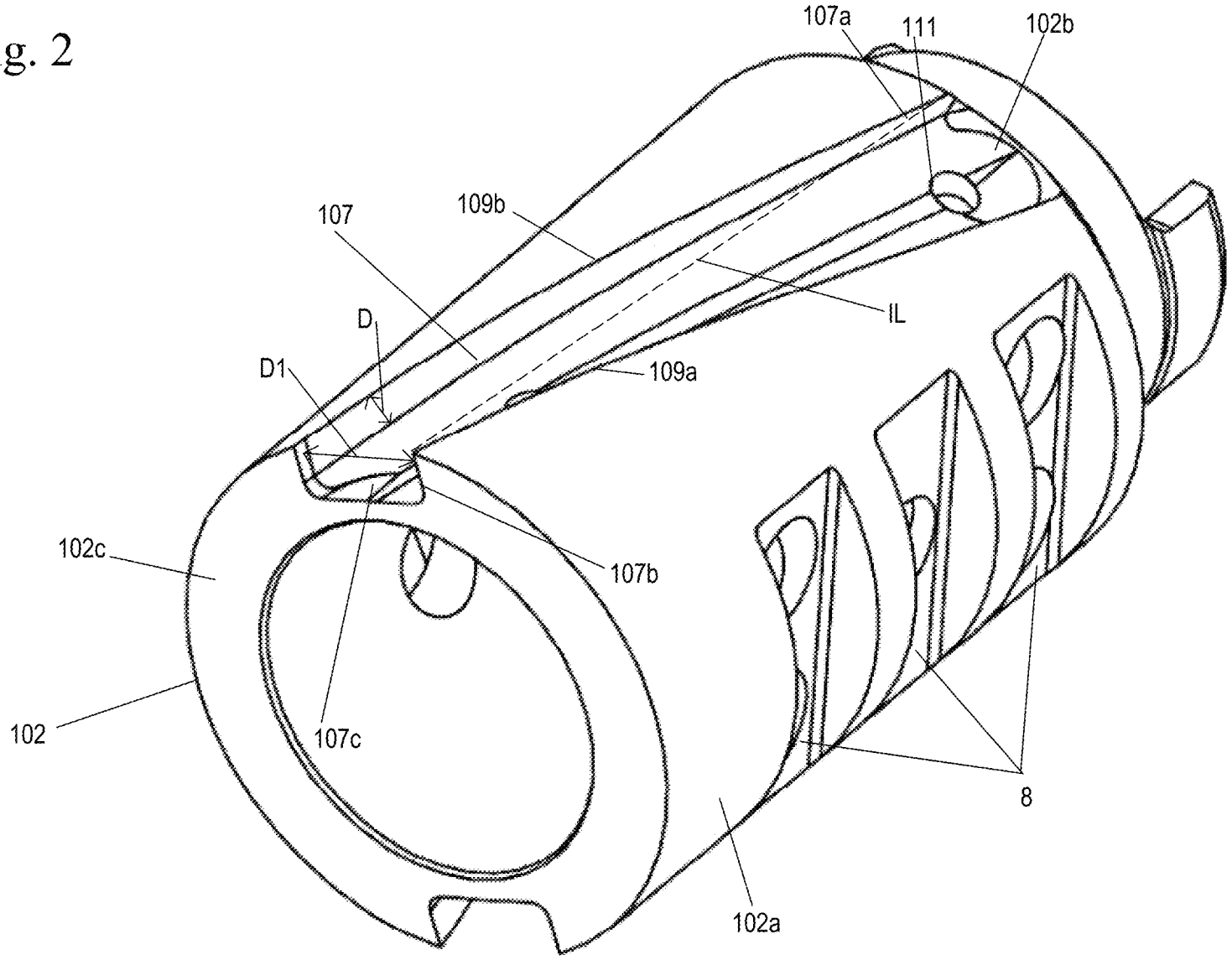
FIG. 2 shows a schematic of a workpiece of a first embodiment with an uninterrupted helical slot on the outer circumference of the workpiece for centerless grinding.

FIG. 2 shows a schematic of a workpiece 102 of a first embodiment with an uninterrupted axial helical groove or slot 107 on the outer circumference 102*a* of the workpiece 102. The axial helical slot 107 extends a length from a first end 102*b* of the workpiece 102 to the second end 102*c*. The axial helical slot 107 has a surface 107*c* and two axial slot sides 109*a*, 109*b* which extend from the outer circumference 102*a* to the surface 107*c* a depth D. Each of the axial slot sides 109*a*, 109*b* each have a first helical slot edge 107*a* and a second helical slot edge 107*b*.

By adding a helical slot 107 relative to the outer circumference 102*a*, helical overlap is present to ensure that contact is consistently maintained between the outer circumference 102*a* of the workpiece 102 and the grinding wheels 5, 6. The helical overlap is shown in FIG. 2 as distance D1 and represents the angular overlap of the start of the helical slot edge or first helical slot edge 107*a* at a first end 102*b* of a first axial slot side 109*a* when compared to the end of the slot edge or second helical slot edge 107*b* of the second axial slot side 109*b* at the opposite, second end 102*c*.

To measure D1, an imaginary line IL is extended from the first helical slot edge 107*a* at a first end 102*b* to the second end 102*c*, with the distance between the imaginary line IL and the second helical slot edge 107*b* at the second end 102*c* being D1 and representative of the helical overlap. The first helical slot edge 107*a* and the second helical slot edge 107*b* overlap to allow the grinding wheel to contact continuously around the outer circumference of the workpiece 102.

Figure 6B:
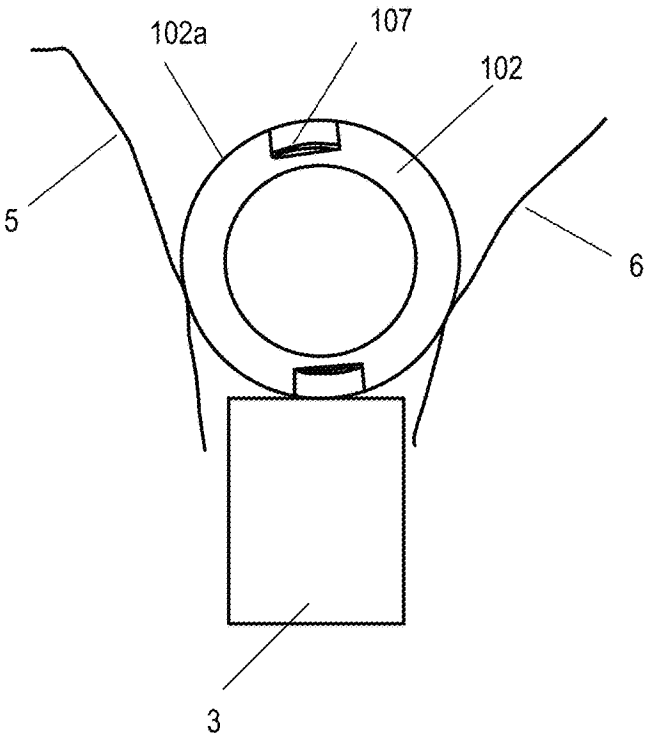
FIG. 6*b* shows a close-up of the workpiece containing a helical axial slot.
Figure 6A:
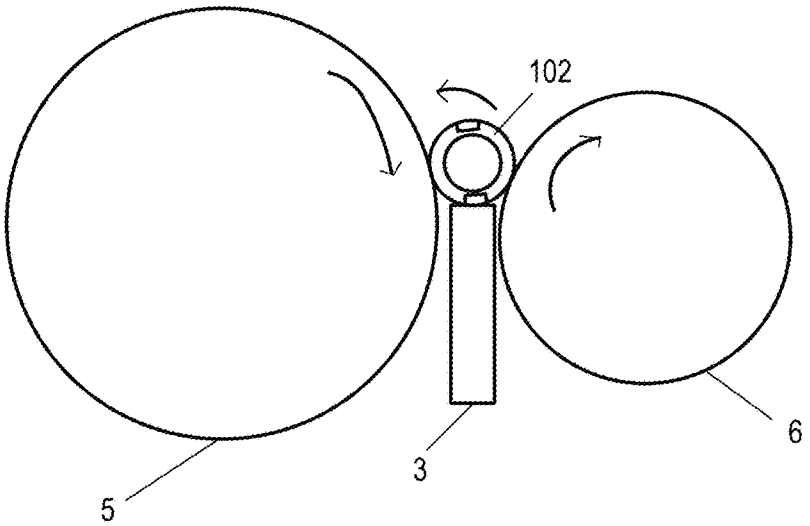
FIG. 6*a* shows a schematic of a centerless grinding layout with a workpiece containing a helical axial slot.

The helical overlap D1 on the outer circumference 102*a* of the workpiece 102 is sized such that the workpiece 102 can rotate freely and maintain continuous tangential contact with the grinding wheels 5, 6 and the platform 3, as the grinding wheels 5, 6 consider the outer circumference 102*a* of the cylindrical workpiece 102 to have no interruptions or to be completely intact as shown in FIGS. 6*a*-6*b*. FIG. 6*b* shows the outside diameter 102*a* of the workpiece 102 in continuous tangential contact with grinding wheels 5, 6 and platform 3 as the workpiece 102 is ground to size.

A control sleeve or control valve can be manufactured using a workpiece 102 described above. The workpiece 102 is placed on a platform 3. The workpiece 102 is secured between two rotary grinding wheels 5, 6 which rotate at the same speed in different directions; grinding the workpiece 102 such that the angular overlap ensures continuous tangential contact with the two rotary grinding wheels as the workpiece 102 is rotated.

Figure 5B:
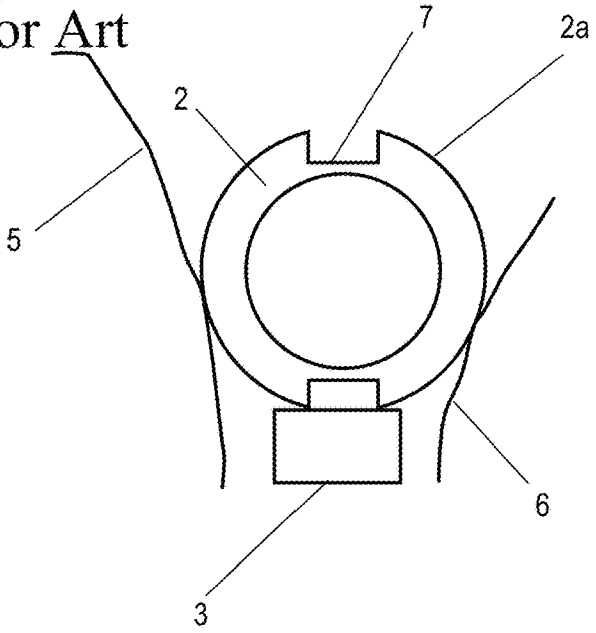
Fig. 5b Prior Art
FIG. 5*b* shows a close-up of the conventional workpiece containing an axial slot.
Figure 5A:
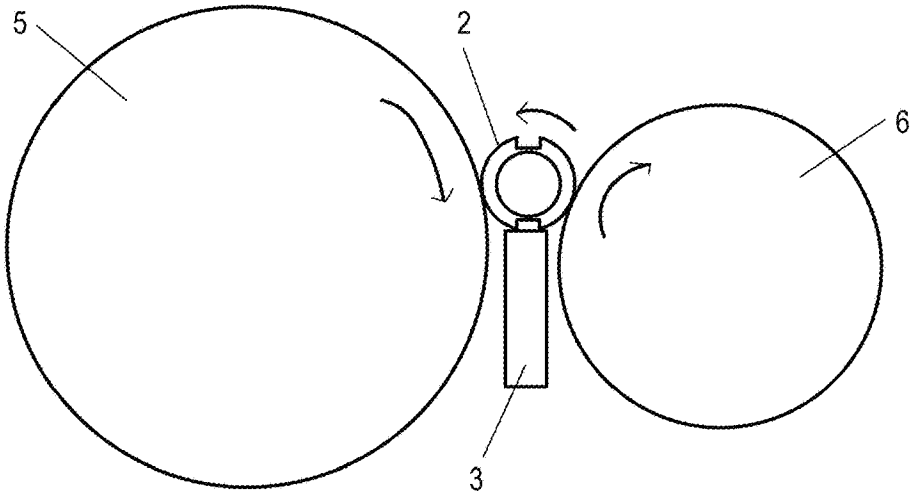
Fig. 5a Prior Art
FIG. 5*a* shows a schematic of a centerless grinding layout with a conventional workpiece containing a axial slot.

It should be noted that in the prior art FIGS. 5*a*-5*b*, the outer circumference 2*a* of the workpiece 2 is interrupted by the straight axial slot 7 such that the outer straight axial slot 7 causes the workpiece 2 to stop when contact occurs between the outer straight axial slot 7 and either the grinding wheels 5, 6 or the platform 3 and that no sizing of the workpiece 2 can occur.

Figure 4:
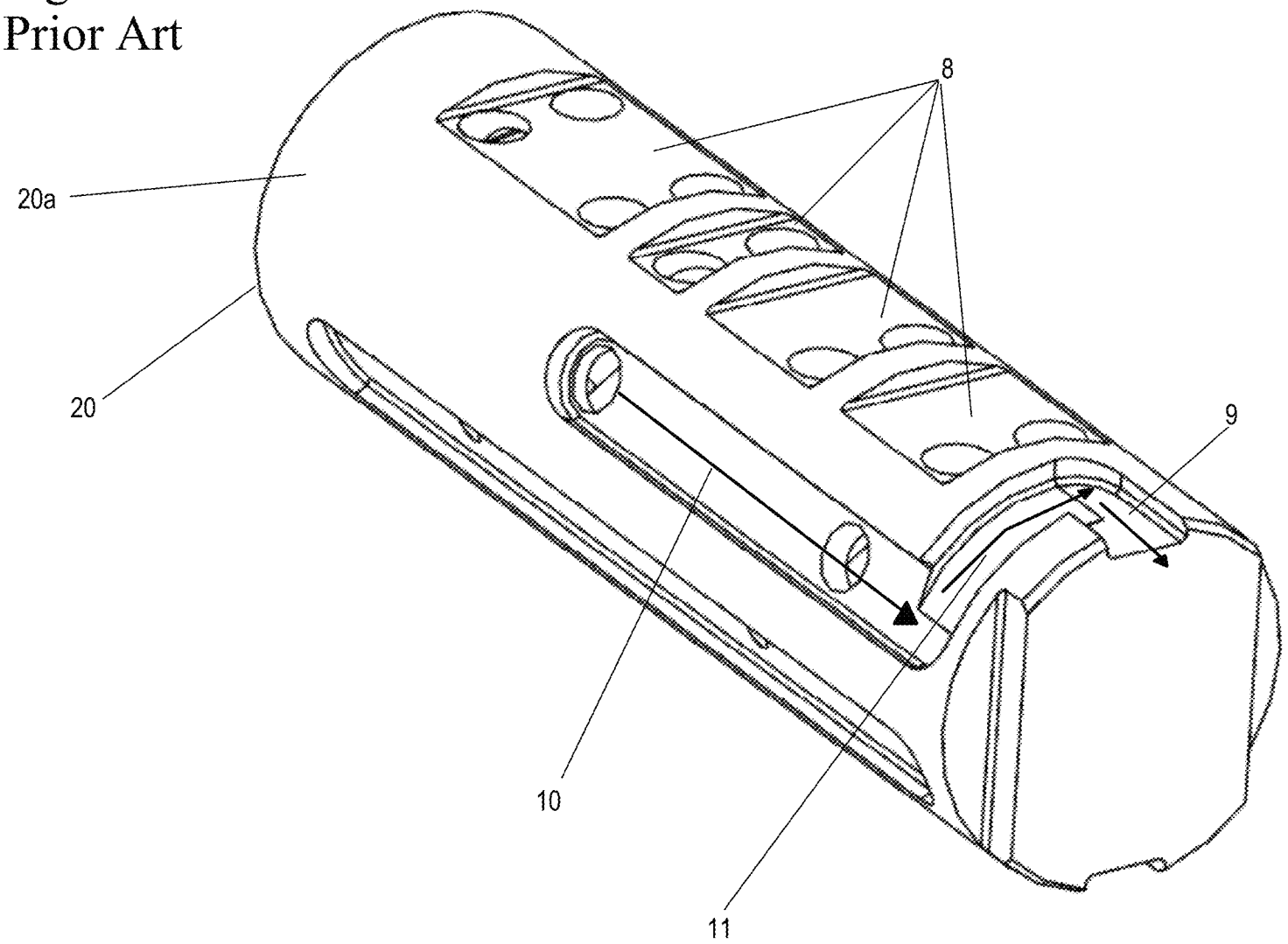
Fig. 4 Prior Art
FIG. 4 shows a schematic of another conventional workpiece with a jog on the outer circumference of the workpiece.

One advantage of the helical slot 107 of an embodiment of the present invention is that the actual cut path is shorter than separate axial slots 9, 10 and angular jogs 11 as shown in the conventional workpiece 20 of FIG. 4. This enables longer tool life and faster machining times for the machine that cuts the slot. Another advantage is that actual fluid flow distance through the helical slot 107 is shorter and results in less pressure drop across the workpiece 102 than compared to multiple axial slots 9, 10 and angular jogs 11 of a conventional workpiece 20. In yet another advantage, the helical slot 107 could be used as an orientation feature in a mating assembly increasing ease of installation.

Figure 3:
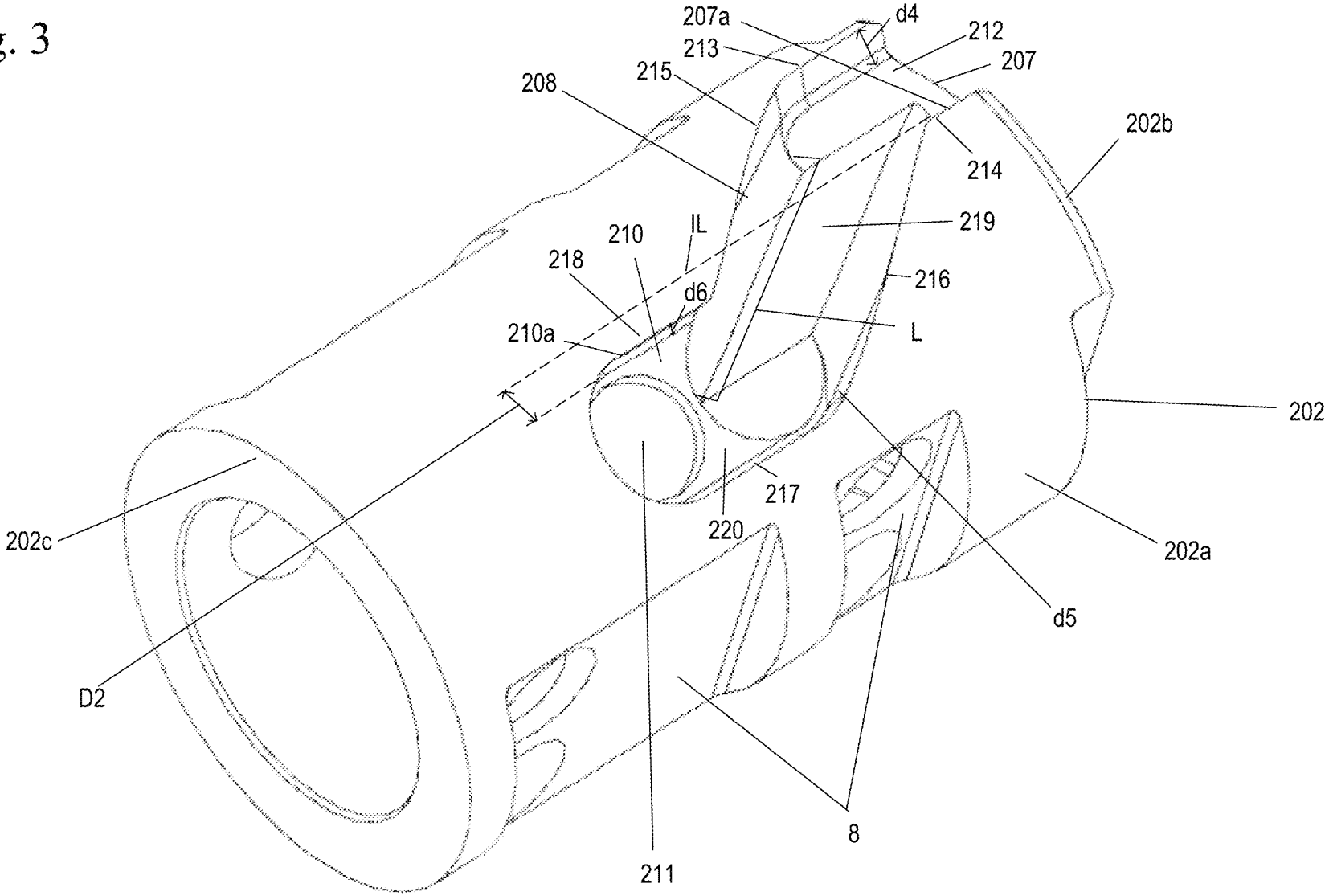
FIG. 3 shows a schematic of a workpiece of a second embodiment with helical slot with a planar surface on an outer circumference of the workpiece for centerless grinding.

FIG. 3 shows a schematic of a workpiece 202 of a second embodiment for centerless grinding. The workpiece 202 has a first end 202*b*, a second end 202*c*, and an outer circumference 202*a*. The outer circumference 202*a* has a first axial flat slot 207 which is connected to a second axial flat slot 210 ending in a hole 211 through a helical jog 208. While the second axial flat slot 210 is shown as ending in a hole 211, the second axial slot 210 or a connecting slot could extend to end 202*c* along the outer circumference 202*a* of the workpiece 202. The first axial flat slot 207 has a flat surface 212 and two axial slot sides 213, 214 which extend a depth d4 from the outer circumference 202*a*. The helical jog 208 has a surface 219 and two helical jog sides 215, 216 which extend a depth d5 to the surface 219 from the outer circumference 202*a*. The second axial flat slot 210 has a surface 220 and two axial slot sides 217, 218 which extend a depth d6 to the flat surface 220 from the outer circumference 202*a*. While the surface 220 is shown is flat in FIG. 3, the surface 220 may also be curved. The axial slot sides 213, 214 are connected to the helical jog sides 215, 216 and the helical jog sides 215, 216 are connected to the axial slot sides 217, 218. The depths d4, d5, d6 of the sides 213, 214, 215, 216, 217, 218 may be the same or different.

The helical jog 208 between the first axial flat slot 207 and the second axial slot 210 has a length L. The helical overlap D2 represents the angular overlap of the first axial flat slot 207 to the second axial flat slot 210. To measure D2, an imaginary line IL is extended from the edge 207*a* of axial flat slot side 214 at a first end 202*b* to the second end 202*c*, with the distance between the imaginary line IL and the edge 210*a* of the axial flat slot side 218 of the second axial flat slot 210 being the helical overlap.

Due to the helical overlap D2 of the helical jog 208, the grinding wheels 5, 6 and the platform 3 are continuously maintained in contact with the outer circumference 202*a* of the workpiece 202.

A control sleeve or control valve can be manufactured using a workpiece 202 described above. The workpiece 202 is placed on a platform 3. The workpiece 202 is secured between two rotary grinding wheels 5, 6 which rotate at the same speed in different directions; grinding the workpiece 202 such that the angular overlap ensures continuous tangential contact with the two rotary grinding wheels as the workpiece 202 is rotated.

In an embodiment of the present invention, the workpiece 102 and 202 is a sleeve for a control valve, or a control valve associated with a variable cam timing phaser. In an alternate embodiment, the workpiece 102 and 202 is a lock pin or detent valve for use with a variable cam timing phaser. In yet other embodiments, the workpiece 102 and 202 is a lock pin or detent valve for use within an engine.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A workpiece for grinding between two grinding wheels and a platform comprising:

a body with an outer circumference having a first end and a second end separated by a length;

a continuous helical groove extending from a first end to the second end along the entire length of the body a depth from the outer circumference, the helical groove having a surface the depth from the outer circumference connected to a first side and a second side;

wherein the helical groove has an angular overlap along the entire length of the body and around the outer circumference of the body measured between an imaginary line drawn from a first edge of the first side at the first end to the second end and to a second edge of the first side at the second end, the imaginary line remaining confined within the continuous helical groove, such that during grinding between the two grinding wheels and the platform, the angular overlap ensures an unbroken, intact, outer circumference continuous tangential contact with the two grinding wheels and the platform as the workpiece is rotated freely on the platform.

2. The workpiece of claim 1, wherein the workpiece is a sleeve of a control valve.

3. The workpiece of claim 1, wherein the workpiece is a control valve of a variable camshaft timing phaser.

4. The workpiece of claim 1, wherein the workpiece is a lock pin.

5. The workpiece of claim 1, wherein the workpiece is a detent valve.

6. The workpiece of claim 1, wherein the surface of the second axial slot is flat.

7. The workpiece of claim 1, wherein the surface of the second axial slot is curved.

8. The workpiece of claim 1, wherein the grinding is centerless grinding.

9. A workpiece for grinding between two grinding wheels and a platform comprising:

a body with an outer circumference having a first end and a second end separated by a length;

a continuous helical slot comprising:

a first axial slot at a first end extending a length towards the second end having a depth from the outer circumference, the first axial slot having a flat surface at the depth from the outer circumference, the flat surface connected to a first side and a second side;

a helical jog having a surface at the depth having first helical jog side and a second helical jog side connected to the first side and the second side of the first axial slot, the helical jog extending a length towards the second end; and a second axial slot having a surface at the depth adjoined to a first side and a second side connected to the first helical jog side and the second helical jog side;

wherein the continuous helical slot has an angular overlap around the outer circumference of the body measured between an imaginary line drawn from a first edge of the first side of the first axial slot at the first end with the flat surface to an edge of the second side of the second axial slot of the continuous helical slot, the imaginary line confined to the second side of the first axial slot, the surface of the helical jog, and first side of the second axial slot, covering a portion of the circumferential surface of the workpiece, such that during grinding between the two grinding wheels and the platform, the angular overlap ensures an unbroken, intact, outer circumference continuous tangential contact with the two grinding wheels and the platform as the workpiece is rotated on the platform.

10. The workpiece of claim 9, wherein the workpiece is a sleeve of a control valve.

11. The workpiece of claim 9, wherein the workpiece is a control valve of a variable camshaft timing phaser.

12. The workpiece of claim 9, wherein the workpiece is a lock pin.

13. The workpiece of claim 9, wherein the workpiece is a detent valve.

14. The workpiece of claim 9, wherein the grinding is centerless grinding.

15. The workpiece of claim 9, wherein the workpiece has a single continuous helical slot.

16. The workpiece of claim 9, wherein the continuous helical slot has a length less than the length of the body between the first end and the second end.

17. The workpiece of claim 9, wherein the continuous helical slot has a length equal to the length of the body between the first end and the second end.

18. A method of manufacturing a control sleeve for a variable cam timing phaser comprising the steps of:

placing a workpiece on a platform, the workpiece comprising: a body with an outer circumference having a first end and a second end separated by a length; and a continuous helical groove extending from a first end to the second end along the entire length of the body a depth from the outer circumference, the helical groove having a surface the depth from the outer circumference connected to a first side and a second side; wherein the helical groove has an angular overlap along the entire length of the body and around the outer circumference of the body measured between an imaginary line drawn from a first edge of the first side at the first end to the second end and to a second edge of the first side at the second end, the imaginary line remaining confined within the continuous helical groove;

feeding the workpiece between two rotary grinding wheels which rotate at the same rotational speed in different directions, but different tangential speeds;

grinding the workpiece such that the angular overlap ensures continuous tangential contact with the two rotary grinding wheels as the workpiece is rotated.

* * * * *